US008682513B2

(12) United States Patent
Chen et al.

(10) Patent No.: US 8,682,513 B2
(45) Date of Patent: Mar. 25, 2014

(54) COMMUNICATION MANAGEMENT SYSTEM AND METHOD FOR A RAIL VEHICLE

(75) Inventors: Yi Chen, Melbourne, FL (US); Jeffrey Twichel, Erie, PA (US); Brian Meyer, Fairview, PA (US); Robert Palanti, Melbourne, FL (US); Scott Sexauer, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/443,400

(22) Filed: Apr. 10, 2012

(65) Prior Publication Data

US 2012/0265379 A1 Oct. 18, 2012

Related U.S. Application Data

(60) Provisional application No. 61/475,528, filed on Apr. 14, 2011.

(51) Int. Cl.
*G06F 17/00* (2006.01)
*B61L 3/12* (2006.01)

(52) U.S. Cl.
USPC ..... 701/19; 701/2

(58) Field of Classification Search
USPC ..... 701/19, 20
See application file for complete search history.

(56) References Cited

U.S. PATENT DOCUMENTS

| | | | | |
|---|---|---|---|---|
| 6,366,585 | B1 | 4/2002 | Dapper | |
| 6,401,015 | B1 | 6/2002 | Stewart | |
| 6,680,918 | B1 | 1/2004 | Haley | |
| 6,759,951 | B2 | 7/2004 | Kellner | |
| 7,395,141 | B1 * | 7/2008 | Seck et al. | 701/19 |
| 2004/0044447 | A1 | 3/2004 | Smith | |
| 2008/0161984 | A1 | 7/2008 | Hrdlicka et al. | |
| 2008/0281477 | A1 | 11/2008 | Hawthorne | |
| 2009/0186325 | A1 * | 7/2009 | Kumar | 434/219 |
| 2009/0312890 | A1 * | 12/2009 | Evans | 701/2 |
| 2010/0049384 | A1 * | 2/2010 | Kraeling et al. | 701/20 |
| 2010/0114404 | A1 * | 5/2010 | Donnelly | 701/2 |
| 2010/0168942 | A1 | 7/2010 | Noffsinger et al. | |
| 2010/0194186 | A1 | 8/2010 | Smith | |
| 2011/0060486 | A1 * | 3/2011 | Meltser et al. | 701/19 |
| 2011/0118899 | A1 * | 5/2011 | Brooks et al. | 701/2 |
| 2011/0118914 | A1 * | 5/2011 | Brooks et al. | 701/20 |
| 2012/0277940 | A1 * | 11/2012 | Kumar et al. | 701/20 |
| 2012/0310453 | A1 * | 12/2012 | Brooks et al. | 701/20 |

OTHER PUBLICATIONS

Search Report and Written Opinion from corresponding PCT Application No. PCT/US2012/033172 dated Oct. 12, 2012.

* cited by examiner

*Primary Examiner* — Behrang Badii
*Assistant Examiner* — Demetra Smith-Stewart
(74) *Attorney, Agent, or Firm* — GE Global Patent Operation; John A. Kramer

(57) ABSTRACT

A communication management system for a vehicle includes a control module, a communication module, and a management module. The control module is disposed on-board a lead powered unit of the vehicle. The control module is configured to automatically change propulsion energy settings of a remote powered unit of the vehicle. The communication module transmits instructions to the remote powered unit to automatically change the propulsion energy settings of the remote powered unit. The communication module identifies communication gaps that represent interruption in one or more communication connections between the lead powered unit and the remote powered unit. The management module compares the propulsion energy settings of the lead powered unit and of the remote powered unit during the communication gaps and, based on the propulsion energy settings, prevents the control module from switching from automatic control of the propulsion energy settings of the remote powered unit to manual control.

16 Claims, 3 Drawing Sheets

COMMUNICATION MANAGEMENT SYSTEM AND METHOD FOR A RAIL VEHICLE

CROSS-REFERENCE TO RELATED APPLICATIONS

This application claims priority to U.S. Provisional Application Ser. No. 61/475,528, which was filed on 14 Apr. 2011 (the "'528 Application"). The entire disclosure of the '528 Application is incorporated by reference.

BACKGROUND

Known powered rail vehicles include one or more powered units and one or more cars. The powered units supply tractive force to propel the powered units and cars. The cars hold or store goods and/or passengers, and may be non-powered units, meaning rail vehicles incapable of self-propulsion. For example, some known powered rail vehicles include a rail vehicle consist (group of vehicles mechanically linked to travel together) having locomotives and cars for conveying goods and/or passengers along a track. Some known powered rail vehicles include several powered units. For example, the systems may include a lead powered unit, such as a lead locomotive, and one or more trailing or remote powered units, such as trailing or remote locomotives, that are located behind and coupled with the lead powered unit or behind rail cars. The lead and trail or remote powered units supply tractive force to propel the system along the track.

The tractive force required to convey the powered units and cars along the track may vary during a trip. For example, due to various parameters that change during a trip, the tractive force that is necessary to move the powered units and the cars along the track may vary. These changing parameters may include the curvature and/or grade of the track, speed limits and/or requirements of the system, and the like. As these parameters change during a trip, the total tractive effort, or force, that is required to propel the system along the track also changes.

Some known rail vehicles provide for the automatic control of the tractive effort provided by at least some of the powered units in the rail vehicle. For example, a first powered unit may automatically control throttle settings and the like for one or more other powered units in the same rail vehicle. The first powered unit may transmit directions to the other powered units over a wireless connection or a wired connection. Due to wireless interference, changes in the terrain (e.g., tunnels and/or curves over or around hills, mountains, rock walls or cliffs, or within valleys), and/or physical damage to wired connections, the communication of directions from the first powered unit to the other powered units can be interrupted. When such interruptions are detected, the first powered unit may switch to a manual state for safety reasons, which requires a human operator to take over control of the powered units.

Some of the interruptions in the communication may be temporary and not permanent. For example, a cause of a communication interruption between powered units may include the rail vehicle entering into a tunnel or valley. However, the rail vehicle may not remain in the tunnel or valley indefinitely (e.g., the rail vehicle may eventually exit the tunnel or valley). But, the first powered unit may have switched to manual control during the temporary communication interruption so that the operator is manually controlling the rail vehicle. Such a switch to manual control may be unnecessary and can reduce fuel efficiency of the rail vehicles as well as affect train handling.

BRIEF DESCRIPTION

In one embodiment, a communication management system for a rail vehicle is provided. The system includes a control module, a communication module, and a management module. The control module is disposed on-board a lead powered unit of the rail vehicle. The control module is configured to automatically change one or more propulsion energy settings of at least one remote powered unit of the rail vehicle. The communication module is disposed on-board the lead powered unit. The communication module is configured to transmit instructions to the remote powered unit to automatically change the propulsion energy settings of the remote powered unit. The communication module also is configured to identify communication gaps that represent interruption in one or more communication connections between the lead powered unit and the remote powered unit. The management module is disposed on-board the lead powered unit. The management module is configured to compare the propulsion energy settings of the lead powered unit and of the remote powered unit during one or more of the communication gaps and, based on the propulsion energy settings, prevent the control module from switching from automatic control of the propulsion energy settings of the remote powered unit to manual control of the propulsion energy settings.

In another embodiment, a system (e.g., a system for communication between powered units of a vehicle) includes a control module, a communication module, and a management module. The control module is configured to be disposed on-board the vehicle that includes a lead powered unit and at least one remote powered unit that are capable of self-propulsion. The control module also is configured to operate in an automatic mode where the control module automatically controls operational settings of the at least one remote powered unit and in a manual mode where an operator onboard the vehicle manually controls the operational settings of the at least one remote powered unit. The communication module is configured to be disposed on-board the vehicle and to monitor communication of control instructions from the control module to the at least one remote powered unit when the control module operates in the automatic mode. The communication module also is configured to identify when the communication of the control instructions is interrupted. The management module is configured to be disposed on-board the vehicle and to determine one or more operational setting differences between operational settings of the lead powered unit and the operational settings of the at least one remote powered unit when the interruption in communication is identified by the communication module. The management module is further configured to prevent the control module from switching from the automatic mode to the manual mode when the one or more operational setting differences meet one or more designated criteria, e.g., if the operational setting differences remain below a designated threshold.

In another embodiment, a method (e.g., a method for communicating between powered units of a vehicle) includes automatically controlling operational settings of at least one remote powered unit in a vehicle by communicating control instructions with the at least one remote powered unit from a lead powered unit of the vehicle, identifying an interruption in communication of the control instructions with the at least one remote powered unit, and determining one or more operational setting differences between operational settings of the lead powered unit and the operational settings of the at least one remote powered unit when the interruption in communication is identified. The method also includes preventing a switch from automatic control of the operational settings of the at least one remote powered unit to manual control of the operational settings of the at least one remote powered unit when the one or more operational setting differences meet one or more designated criteria, e.g., when the one or more operational setting differences remain below a designated threshold.

In another embodiment, a communication management system for a rail vehicle includes a control module, a communication module, and a management module. The control module is configured to be disposed on-board a lead powered unit of the rail vehicle and to automatically change one or more propulsion energy settings of at least one remote powered unit of the rail vehicle. The communication module is configured to be disposed on-board the lead powered unit and to transmit instructions to the at least one remote powered unit to automatically change the propulsion energy settings of the at least one remote powered unit. The communication module is further configured to identify communication gaps that represent interruption in one or more communication connections between the lead powered unit and the at least one remote powered unit. The management module is configured to be disposed on-board the lead powered unit and to compare the propulsion energy settings of the lead powered unit and the propulsion energy settings of the at least one remote powered unit during one or more of the communication gaps. The management module is further configured to, based on the propulsion energy settings of the lead powered unit and the at least one remote powered unit, prevent the control module from switching from automatic control of the propulsion energy settings of the at least one remote powered unit to manual control of the propulsion energy settings of the at least one remote powered unit.

DETAILED DESCRIPTION

Figure 1:
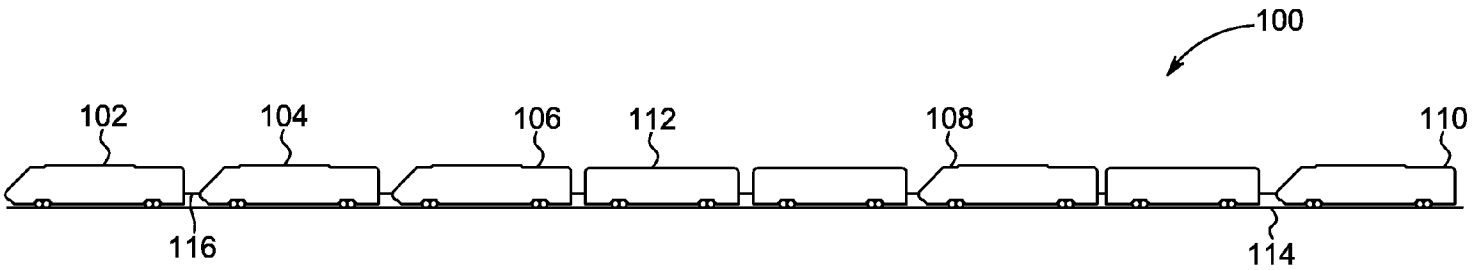
FIG. 1 is a schematic illustration of one embodiment of a rail vehicle.

The foregoing summary, as well as the following detailed description of certain embodiments of the inventive subject matter, will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It should be noted that although one or more embodiments may be described in connection with trains or other powered rail vehicles, the embodiments described herein are not limited to trains. In particular, one or more embodiments may be implemented in connection with different types of rail vehicles (e.g., a vehicle that travels on one or more rails, such as single locomotives and railcars, powered ore carts and other mining vehicles, light rail transit vehicles, and the like) and other vehicles, such as other off-highway vehicles, marine vehicles, automobiles, and the like. Additionally, for embodiments herein that relate to a vehicle, such embodiments are applicable to rail vehicle consists and other vehicle consists, referring to a group of separable vehicles that are mechanically linked to travel together along a route. A rail vehicle consist, for example, may include one or more locomotives or other powered units (capable of self-propulsion) and one or more non-powered units (e.g., freight or passenger cars) that are incapable of self-propulsion. Example embodiments are provided of systems and methods that monitor operational settings of powered units in a vehicle (that includes two or more of the powered units interconnected with each other) and, based on a determination of whether the settings and/or differences between the settings meet one or more criteria, a mode of operation of one or more of the powered units can be switched from a first mode to a separate, different and/or discrete mode of operation. In one embodiment, the systems and methods may permit control of remote powered units in a distributed power vehicle after a temporary loss of communication between a lead powered unit and one or more of the remote powered units in the vehicle are provided. At least one technical effect described herein includes a method and system that permits continued remote control of one or more remote powered units from the lead powered unit after a break in communication between the powered units occurs.

FIG. 1 is a schematic illustration of one embodiment of a vehicle 100. Although the vehicle 100 is illustrated and described herein as a rail vehicle, the vehicle 100 may represent one or more other vehicles, as described above. The vehicle 100 includes a lead powered unit 102 mechanically coupled with several remote powered units 104, 106, 108, 110 and non-powered units 112. The vehicle 100 travels along a route 114 (e.g., a track, road, waterway, and the like). The lead powered unit 102 and the remote powered units 104, 106, 108, 110 supply tractive forces to propel the vehicle 100 along the route 114. In one embodiment, the vehicle 100 is a consist that includes the lead powered unit 102 as a leading locomotive disposed at the front end of the vehicle 100 and the remote powered units 104, 106, 108, 110 as trailing locomotives disposed behind the lead powered unit 102 between the lead powered unit 102 and the back end of the vehicle 100. Alternatively, the lead powered unit 102 may be disposed between one or more of the remote powered units 104, 106, 108, 110 and the back end of the vehicle 100. The non-powered units 112 may be cars for carrying cargo (e.g., goods and/or passengers) along the route 114. The number, arrangement, and/or distribution of the units 102, 104, 106, 108, 110, 112 in the vehicle 100 are provided merely as one example and are not intended to limit the scope of all embodiments described herein.

The remote powered units 104, 106, 108, 110 are remote from the lead powered unit 102 in that the remote powered units 104, 106, 108, 110 are not located within the lead powered unit 102. A remote powered unit 104, 106, 108, 110 need not be separated from the lead powered unit 102 by a significant distance in order for the remote powered unit 104, 106, 108, 110 to be remote from the lead powered unit 102. For example, the remote powered unit 104 may be directly adjacent to and coupled with the lead powered unit 102 and still be remote from the lead powered unit 102. In another embodiment, a remote powered unit may be separated from the lead powered unit 102 by one or more non-powered units 112.

In operation, the lead powered unit 102 remotely controls tractive operations of one or more of the remote powered units 104, 106, 108, 110. For example, each powered unit 102, 104, 106, 108, 110 may be a locomotive having one or more traction motors and/or one or more brakes. The traction motors can have different throttle and/or power settings that control how fast the powered units move and/or how much horse power is applied to the axles and wheels of the various powered units 102, 104, 106, 108, 110. Higher throttle and/or power settings increase the amount of horse power applied to axles and wheels in order to increase the tractive effort provided by the associated powered unit 102, 104, 106, 108, 110 and potentially speed up movement of the vehicle 100. Conversely, lower throttle and/or power settings can cause the traction motors to provide less horse power in order to decrease the tractive effort provided by the associated powered unit 102, 104, 106, 108, 110 and potentially slow down movement of the vehicle 100, or at least not increase the speed of the vehicle 100.

In one embodiment, the lead powered unit 102 can communicate with the remote powered units 104, 106, 108, 110 in order to remotely change and control the throttle and/or power settings of the remote powered units remote powered units 104, 106, 108, 110. The lead powered unit 102 may communicate instructions to the remote powered units remote powered units 104, 106, 108, 110 via one or more wired connection 116 (e.g., a multiple unit, or MU, cable) and/or a wireless connections (e.g., wireless radio frequency, or RF, transmissions) between the lead powered unit 102 and one or more of the remote powered units 104, 106, 108, 110. By way of non-limiting example only, the wired connection 116 may be a wire or group of wires, such as a trainline or MU cables, that extends through the powered units remote powered units 102, 104, 106, 108, 110 and non-powered units 112.

Figure 2:
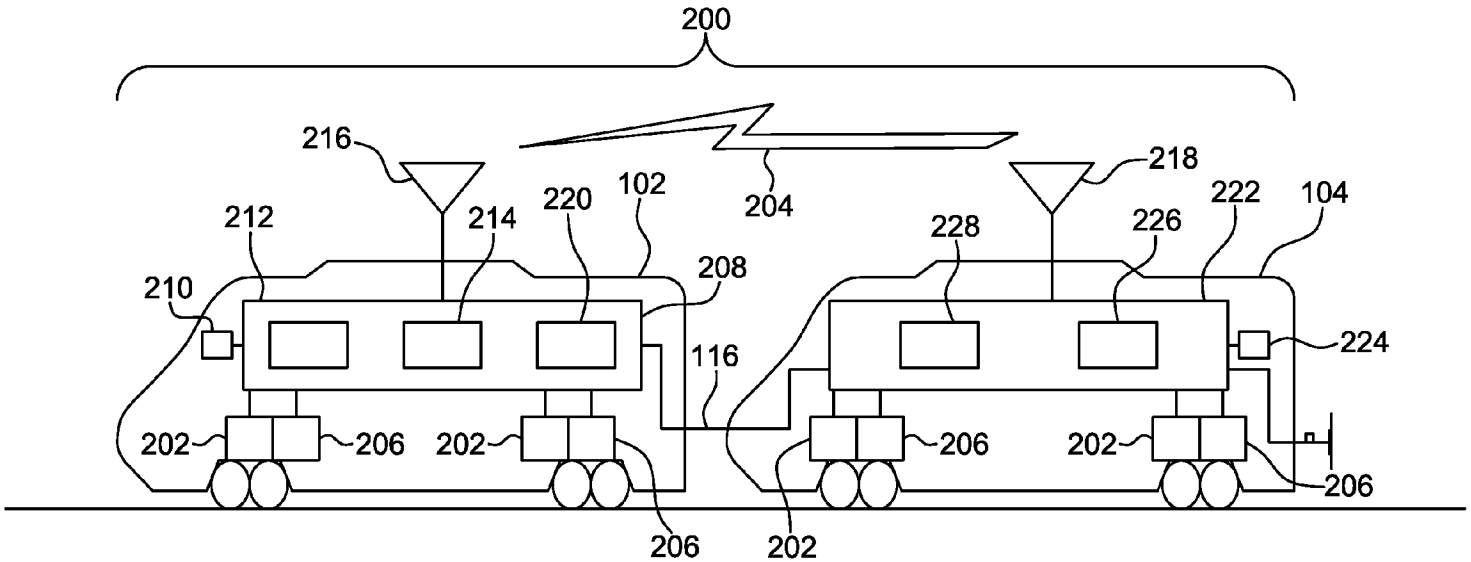
FIG. 2 is a schematic diagram of one embodiment of a communication management system of the rail vehicle.

FIG. 2 is a schematic diagram of one embodiment of a communication management system 200 of the vehicle 100. The illustration shown in FIG. 2 only includes the lead powered unit 102 and the remote powered unit 104, but the discussion herein may also apply to one or more, or all, of the remote powered units 106, 108, 110 (shown in FIG. 1). The communication management system 200 can be used to control communications between the powered units 102, 104, 106, 108, 110. While the description herein relates to using the communication management system 200 to control propulsion energy settings of the powered units 102, 104, 106, 108, 110 in connection with a distributed power (DP) system, alternatively, the communication management system 200 may be used to manage communications between the powered units 102, 104, 106, 108, 110 that are used in non-DP systems. For example, instead of the communication management system 200 being used to remotely control tractive efforts provided by the remote powered units 104, 106, 108, 110 from the lead powered unit 102, alternatively, the communication management system 200 may be used to coordinate other aspects of operations of the powered units 102, 104, 106, 108, 110.

In one embodiment, the communication management system 200 is used to remotely control operations of the powered units (e.g., by controlling the tractive effort supplied by one or more of the powered units 102, 104, 106, 108, 110) from another powered unit 102, 104, 106, 108, 110. For example, the lead powered unit 102 may change throttle and/or power settings of traction motors 202 and/or settings of brakes 206 in one or more of the remote powered units 104, 106, 108, 110 by communicating instructions to the remote powered units 104, 106, 108, 110. The instructions may be communicated over or through the wired connection 116 and/or a wireless connection 204, such as an RF connection.

The communication management system 200 includes a master control unit 208. As used herein, the terms "unit" or "module" include a hardware and/or software system that operates to perform one or more functions. For example, a unit or module may include one or more computer processors, controllers, and/or other logic-based devices that perform operations based on instructions stored on a tangible and non-transitory computer readable storage medium, such as a computer memory. Alternatively, a unit or module may include a hard-wired device that performs operations based on hard-wired logic of a processor, controller, or other device. In one or more embodiments, a unit or module includes or is associated with a tangible and non-transitory (e.g., not an electric signal) computer readable medium, such as a computer memory. The units or modules shown in the attached figures may represent the hardware that operates based on software or hardwired instructions, the computer readable medium used to store and/or provide the instructions, the software that directs hardware to perform the operations, or a combination thereof.

The master control unit 208 can include a computer processor, microprocessor, controller, microcontroller, and/or other logic-based device that operates based on one or more sets of instructions stored on a computer readable storage medium 210. The master control unit 208 can include appropriate signal conditioners to transmit and receive desired information (e.g., data), and correspondingly may include filters, amplifiers, limiters, modulators, demodulators, CODECs, signal formal converters (such as analog-to-digital and digital-to-analog converters), clamps, power supplies (e.g., battery), power converters, and the like, as needed to perform various control, communication, evaluation, and processing operations described herein. The master control unit 208 can be comprised of one or more components of any type suitable to process input signals and provide desired output signals. Such components may include digital circuitry, analog circuitry, or a combination of both. The master control unit 208 can be of a programmable type; a dedicated, hard-wired state machine; or a combination of these; and can further include multiple processors, arithmetic-logic units (ALUs), central processing units (CPUs), or the like. For forms of the master control unit 208 with multiple processing units, distributed, pipelined, and/or parallel processing can be utilized. While the master control unit 208 is shown as being disposed onboard the lead powered unit, alternatively, the master control unit 208 may be disposed onboard one or more of the remote powered units. The medium 210 may include a tangible and non-transitory computer readable storage medium such as a solid-state, electromagnetic, and/or optical memory. The medium 210 can be volatile, nonvolatile, or a mixture thereof. Some or all of the medium 210 can be portable, such as a disk, card, memory stick, cartridge, and the like.

The master control unit 208 includes one or more modules that are used to control operations (e.g., throttle, power, and/or brake settings) of the remote powered units 104, 106, 108, 110 (shown in FIG. 1). As used herein, "propulsion energy settings" refers to the settings of the remote powered units 104, 106, 108, 110 that can be adjusted or changed by the communication management system 200 in order to alter the tractive effort and/or braking effort provided by the traction motors 202 and/or brakes 206 of the powered units 102, 104, 106, 108, 110. The modules may be formed based on one or more sets of instructions stored on the medium 210. Alternatively, one or more of the modules may be an additional control unit.

A management module 212 monitors operational settings of the powered units 102, 104, 106, 108, 110. For example, the management module 212 may track the throttle, power, and/or brake settings of one or more of the powered units 102, 104, 106, 108, 110 over time. The management module 212 can create a history of the operational settings of the powered units 102, 104, 106, 108, 110 and store the history in the medium 210.

A communication module 214 monitors communication connections between the lead powered unit 102 and one or more of the remote powered units 104, 106, 108, 110. For example, the communication module 214 can determine if data (e.g., control instructions to change propulsion energy settings) is successfully transmitted from the lead powered unit 102 to one or more of the remote powered units 104, 106, 108, 110 (shown in FIG. 1) and/or if the one or more remote powered units 104, 106, 108, 110 receive the data. In one embodiment, the master control unit 208 of the lead powered unit 102 may direct an antenna 216 disposed on-board the lead powered unit 102 to wirelessly transmit instructions to one or more of the remote powered units 104, 106, 108, 110 that directs the one or more remote powered units 104, 106, 108, 110 to change propulsion energy settings. Alternatively or in addition, the instructions may be communicated to the remote powered units 104, 106, 108, 110 through the wired connection 116. The instructions may be transmitted as network data, such as data that is communicated as data signals or data packets, such as according to the TCP/IP protocol. For example, the data may be transmitted in sequential packets of data having a header containing addressing information and an envelope containing information that is communicated using the data packets.

Upon receipt and/or implementation of the instructions at the one or more remote powered units 104, 106, 108, 110 (shown in FIG. 1), the remote powered units 104, 106, 108, 110 that received and/or acted in accordance with the instructions may transmit a confirmation response to the lead powered unit 102. For example, the remote powered units 104, 106, 108, 110 may transmit network data that represents confirmation that the instructions were received and/or acted upon by the remote powered unit 104, 106, 108, and/or 110. The remote powered units 104, 106, 108, 110 may transmit such confirmation responses to the lead powered unit 102 using antennas 218 (e.g., transmit wireless signals) and/or the wired connection 116.

In one embodiment, the communication module 214 monitors communication connections between the lead powered unit 102 and the remote powered units 104, 106, 108, 110 (shown in FIG. 1) by determining if responsive confirmation messages (also referred to as response confirmations) are transmitted by the remote powered units 104, 106, 108, 110 and received by the lead powered unit 102 after control instructions (also referred to as control messages or instructions) are transmitted by the lead powered unit 102. If confirmation messages are not received by the lead powered unit 102 after one or more control instructions are transmitted to the remote powered units 104, 106, 108, 110, then the communication module 214 may identify a break or interruption in the communication connection between the lead powered unit 102 and one or more of the remote powered units 104, 106, 108, 110. For example, if a timer expires or some other measure of time lapses after an instruction is transmitted from the lead powered unit 102 to one or more remote powered units 104, 106, 108, 110 before a corresponding response confirmation is received at the lead powered unit 102, then the communication module 214 may identify a break or interruption in the communication connection. Such breaks or interruptions may be caused by physical damage to the wired connection 116, wireless interference with the wireless connection 204, changes in terrain (e.g., curves, tunnels, hills, rock walls or cliffs, or mountains) that block or significantly impede the wireless connection 204, and the like.

A control module 220 controls the operational settings (e.g., propulsion energy settings) of the traction motors 202 and/or the brakes 206 of the lead powered unit 102. For example, the control module 220 may vary or adjust the throttle and/or power settings of one or more traction motors 202 and/or change settings of one or more brakes 206 based on manual input from an operator and/or automatically. In one embodiment, the control module 220 operates in an automatic state (also referred to as an automatic mode) or a manual state (also referred to as a manual mode). In the automatic state or mode, the control module 220 can automatically control the propulsion energy settings based on a trip plan generated by a system used for energy management of a vehicle (e.g., an energy management system). One example of such a system is Trip Optimizer™ provided by General Electric Company. The trip plan may include various propulsion energy settings for the powered units 102, 104, 106, 108, 110 that are based on the route that the vehicle 100 is traveling on and/or will travel on during a trip, the loads carried by the vehicle 100, emission limitations along the route of the trip, speed limits of the route, and the like. The propulsion energy settings may be expressed as a function of time and/or distance along the route 114 during a trip. Operating the powered units and/or vehicle according to the trip plan can result in reducing the amount of fuel consumed and/or emissions generated by the powered units and/or vehicle during the trip relative to operating according to one or more other settings. In the manual state or mode of the control module 220, a human operator manually controls the propulsion energy settings.

The communication management system 200 includes a slave control unit 222 (also referred to as a slave processor) disposed on-board the remote powered unit 104. The remote powered units 106, 108, 110 also may include the slave control unit 222 and other components shown in FIG. 2. The slave processor 222 may be similar to the master control unit 208 and may operate based on one or more sets of instructions stored on a computer readable storage medium 224. The medium 224 may be similar to the medium 210. The slave control unit 222 includes one or more modules that are used to control operational settings (e.g., throttle, power, and/or brake settings) of the remote powered units 104, 106, 108, 110 (shown in FIG. 1). As used herein, "propulsion energy settings" refers to the settings of the remote powered units 104, 106, 108, 110 that can be adjusted or changed by the communication management system 200 in order to alter the tractive effort and/or braking effort provided by the traction motors 202 and/or brakes 206 of the powered units 102, 104, 106, 108, 110. The modules may be formed based on one or more sets of instructions stored on the medium 210. Alternatively, one or more of the modules may be an additional processor.

A communication module 226 receives control messages (e.g., instructions) from the lead powered unit 102 and provides responsive confirmation messages (e.g., response confirmations) to the lead powered unit 102 to confirm receipt of the control messages. For example, the communication module 226 may monitor the antenna 218 and/or wired connection 116 for instructions received over the same, and when instructions are received, the communication module 226 may transmit a response confirmation to the lead powered unit 102 over the wireless connection 204 and/or the wired connection 116.

A control module 228 controls the operational settings (e.g., propulsion energy settings) of the traction motors 202 and/or the brakes 206 of the remote propulsion unit 104. For example, the control module 228 may vary or adjust the throttle and/or power settings of one or more traction motors 202 and/or change settings of one or more brakes 206 based on manual input from an operator and/or the instructions received from the lead powered unit 102.

Figure 3:
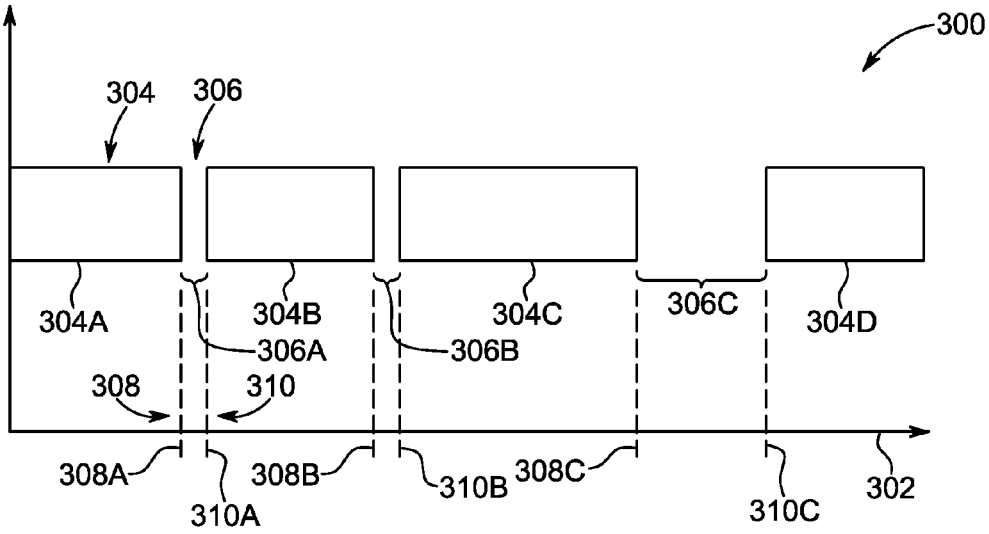
FIG. 3 is a graphical representation of one example of a status of one or more communication connections between a lead powered unit and one or more remote powered units of the rail vehicle.

FIG. 3 is a graphical representation of one example of a status 300 of one or more communication connections between the lead powered unit 102 (shown in FIG. 1) and one or more of the remote powered units 104, 106, 108, 110 (shown in FIG. 1). The status 300 is shown alongside a horizontal axis 302 representative of time. The status 300 represents time periods 304 of active communication connections between the lead powered unit 102 and one or more of the remote powered units 104, 106, 108, 110.

Each of the time periods 304 (e.g., time periods 304A, 304B, 304C, 304D) represents a time window during which the lead powered unit 102 (shown in FIG. 1) transmits instructions to one or more of the remote powered units 104, 106, 108, 110 (shown in FIG. 1) and the remote powered units 104, 106, 108, 110 receive the instructions. The time periods 304 may be measured (e.g., the start and ending times of each time period 304 may be identified) by the communication module 214 (shown in FIG. 2) of the lead powered unit 102. For example, the communication module 214 may define the time periods 304 as the times during which instructions are transmitted to, and confirmation responses are received from, one or more of the remote powered units 104, 106, 108, 110 at the lead powered unit 102. In one embodiment, the communication module 214 determines if a confirmation response is received from a remote powered unit 104, 106, 108, 110 within a predetermined time limit after transmission of an instruction from the lead powered unit 102. In one embodiment, this time limit is a relatively short time period, such as a few milliseconds to a few seconds. Alternatively, this time limit may be longer or shorter. If the confirmation response is received within the predetermined time limit, then the communication connection (e.g., the wired connection 116 or wireless connection 204) may be identified by the communication module 214 as being present between the lead powered unit 102 and one or more of the remote powered units 104, 106, 108, 110. For example, if a confirmation is received, then a current time period 304 that includes when the instructions are transmitted is extended. The time periods 304 represent the presence of the communication connection between the lead powered unit 102 and one or more of the remote powered units 104, 106, 108, 110.

On the other hand, if the confirmation response is not received within the predetermined time limit, then the communication connection may be identified by the communication module 214 (shown in FIG. 2) as being at least temporarily interrupted or broken between the lead powered unit 102 (shown in FIG. 1) and one or more of the remote powered units 104, 106, 108, 110 (shown in FIG. 1). For example, if the confirmation is not received (or if no confirmation is received after a designated number of repeated attempts to communicate), then a current time period 304 may terminate. The communication module 214 may determine that the time period 304 has ended and that a communication gap 306 has begun. The communication gaps 306A, 306B, 306C shown in FIG. 3 correspond to time periods or time windows where the communication module 214 does not receive confirmation responses from the remote powered units 104, 106, 108, 110 within the time limit described above. The communication gaps 306 end when the communication module 214 begins receiving confirmation responses from the remote powered units 104, 106, 108, 110.

The communication gaps 306 may be temporary. For example, in operation, the vehicle 100 (shown in FIG. 1) may travel through tunnels, areas with significant wireless interference, and/or over other terrain (e.g., hills, peaks, mountains, valleys, rock walls or cliffs, and the like) that causes one or more of the communication gaps 306. Once the vehicle 100 travels out of the tunnel, area with wireless interference, or other terrain, the communication gap 306 may end and the interruption in communication between the lead powered unit 102 (shown in FIG. 1) and one or more of the remote powered units 104, 106, 108, 110 (shown in FIG. 1) may begin or continue.

During the communication gaps 306, the management module 212 (shown in FIG. 2) of the lead powered unit 102 may determine the current operational settings (e.g., current propulsion energy settings) of the lead powered unit 102 and the remote powered units 104, 106, 108, 110. For example, the management module 212 may identify the throttle and/or power settings of each of the powered units 102, 104, 106, 108, 110 that were used when communication between the lead powered unit 102 and the remote powered units 104, 106, 108, and/or 110 was lost.

Figure 4:
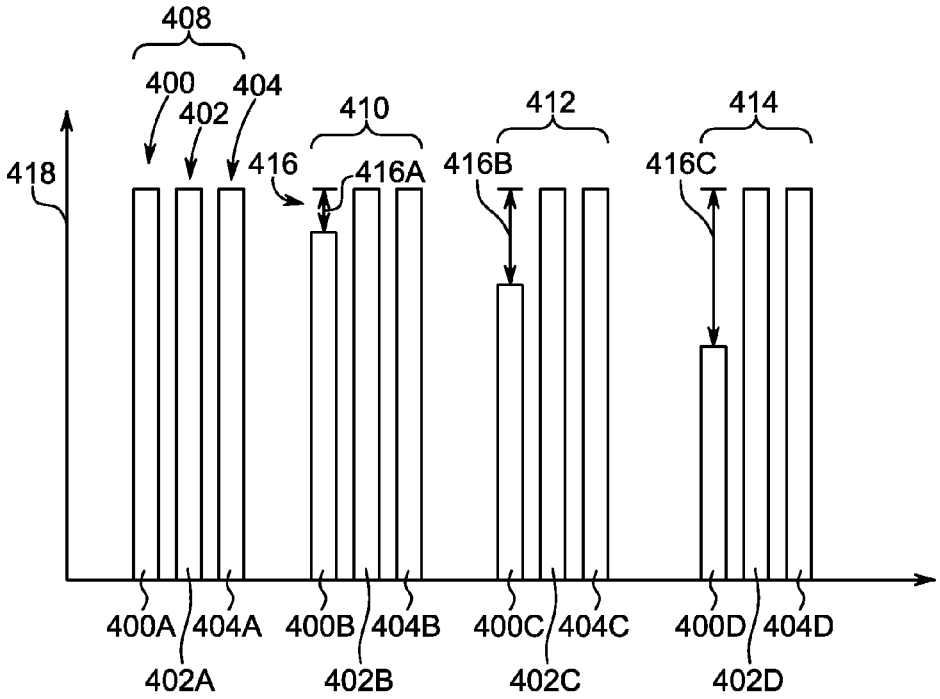
FIG. 4 illustrates examples of histograms of operational settings of the powered units of the rail vehicle.

FIG. 4 illustrates examples of histograms 408, 410, 412, 414 of operational settings 400, 402, 404 (such as propulsion energy settings) of the powered units 102, 104, 106 of the vehicle 100. The operational settings 400, 402, 404 may represent the throttle and/or power settings of the lead powered unit 102, the remote powered unit 104, and the remote powered unit 106, respectively. Alternatively, the operational settings 400, 402, 404 may represent other settings, such as brake settings, power output, or other settings. The histograms 408, 410, 412, 414 are shown alongside a vertical axis 418 that represents different operational settings 400, 402, 404.

While the operational settings 402 and 404 are only shown for the remote powered units 104 and 106, alternatively, the operational settings for additional remote powered units 108 and/or 110 also may be shown. The operational settings of the lead powered unit 102 are referred to by the reference numbers 400 (e.g., 400A, 400B, 400C). The operational settings of the remote powered unit 104 are referred to by the reference number 402 (e.g., 402A, 402B, 402C). The operational settings of the remote powered unit 106 are referred to by the reference number 404 (e.g., 404A, 404B, 404C).

Each of the histograms 408, 410, 412, 414 represents the operational settings 400, 402, 404 at different times. For example, the histograms 408, 410, 412, 414 may each represent the operational settings 400, 402, 404 at subsequent and/or sequential times. In the illustrated embodiment, the operational settings 402, 404 of the remote powered units remain constant because the operational settings 402, 404 are based on the last known operational settings 402, 404 of the remote powered units prior to the loss of communication between the lead powered unit 102 and the remote powered units. Alternatively, the operational settings 402, 404 may not remain constant and may change. For example, in response to an identified communication loss, one or more of the operational settings 402, 404 may change to a default or other designated setting.

The management module 212 (shown in FIG. 2) identifies operational setting differences 416 (e.g., differences 416A, 416B, 416C) between the operational settings 400 of the lead powered unit 102 (shown in FIG. 1) and the operational settings 402, 404 of the remote powered units 104, 106 (shown in FIG. 1) alter communication is lost. The management module 212 compares the operational settings and/or the operational setting differences 416 to one or more criteria to determine if the settings and/or differences meet the criteria and, as a result, an operational mode of the vehicle should be changed. In one embodiment, the operational setting differences 416 can be compared to a designated setting threshold (e.g., a propulsion threshold) to determine if the operational setting differences 416 exceed the threshold. Alternatively, one or more of the operational settings and/or differences can be compared to a threshold, can be examined for designated changes, or otherwise compared to criteria to determine if the mode of the vehicle should be changed. While the discussion herein focuses on the comparison of operational settings and/or differences to a threshold, not all embodiments of the inventive subject matter are so limited. For example, the settings, differences, or other characteristics of operations of the vehicle may be compared to criteria other than a threshold to determine whether to switch the mode of the vehicle.

Figure 5:
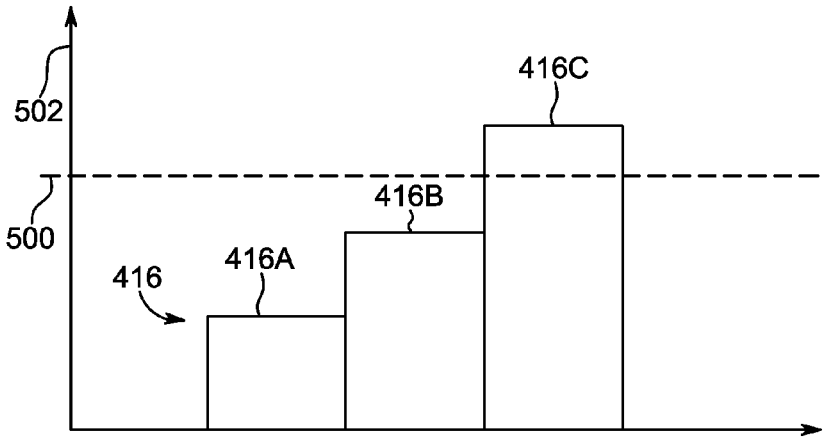
FIG. 5 is a graphical representation of one embodiment of a comparison between operational differences and a threshold.

FIG. 5 is a graphical representation of one embodiment of a comparison between the operational setting differences 416 and a designated setting (e.g., propulsion) threshold 500. The operational setting differences 416 are shown alongside a vertical axis 502 that represents a magnitude of the operational setting differences 416. In the illustrated embodiment, the operational setting differences 416A and 416B do not exceed the threshold 500 but the operational setting difference 416C exceeds the threshold 500. The threshold 500 may be a predefined and/or a static value stored in the medium 210 (shown in FIG. 2). Alternatively, the threshold 500 may be a dynamic value (e.g., a value that can change over time), as described below.

During a communication gap 306 (shown in FIG. 3), if the management module 214 (shown in FIG. 2) determines that the operational setting difference 416 exceeds the threshold 500 (e.g., the operational setting difference 416C), then the management module 214 may direct the control module 220 to switch from automatic control to manual control. As described above, prior to the operational setting differences 416 exceeding the threshold 500, the control module 220 may automatically control the operational settings of the traction motors 202 and/or the brakes 206 of the lead powered unit 102. Once the operational setting difference 416 exceeds the threshold 500, the control module 220 may switch operating modes of the vehicle.

The operating modes may be distinct or different modes of operation. The modes of operation may be different in that different controls, communications, and/or rules are used in connection with operating the vehicle in the different modes. As one example, different modes may include automatic control and manual control of the vehicle (e.g., control of the throttle and/or brake settings). In another example, the different modes may include a mode of operation where the operational settings of the powered units are controlled according to a trip plan (as described above) and a different mode of operation where the operational settings of the powered units are controlled according to a DP configuration (as described above). Another example is switching between different communication modes, with different types of information, different message formats, different sources and/or receivers of information, and the like, being communicated between the different modes. Alternatively, the different operating modes may include other modes. While the discussion herein focuses on switching between automatic and manual modes of operations, not all embodiments are so limited. Some embodiments of the inventive subject matter may switch between other modes of operation.

The management module 214 may provide a visual, audible, and/or tactile notification to an operation of the switch from automatic to manual control, such as a light, text display, audible alarm, and/or vibration of a chair, handle, and the like. After the operational setting difference 416 exceeds the threshold 500, the control module 220 does not automatically control the operational settings, and a human operator may be required to change the operational settings in one embodiment.

The management module 214 can direct the control module 220 to switch from automatic to manual control independent of the length of time that the communication gap 306 (shown in FIG. 3) lasts. For example, in one embodiment, as long as the operational setting differences 416 between the lead powered unit 102 (shown in FIG. 1) and one or more of the remote powered units 104, 106, 108, 110 (shown in FIG. 1) remains below the threshold 500, the lead powered unit 102 can remain in an automatic control state, whereby the lead powered unit 102 attempts to automatically control the operational settings of the remote powered units 104, 106, 108, 110, such as by continuing to send control messages or instructions to the remote powered units after the communication loss is identified. If the communication gap 306 ends and the lead powered unit 102 is able to transmit control instructions to the remote powered units 104, 106, 108, 110, the lead powered unit 102 can resume automatic control of the operational settings of the remote powered units 104, 106, 108, 110.

In the illustrated embodiment, the threshold 500 is a static threshold. For example, the threshold 500 may be constant or approximately constant, and not change over time or during the course of a trip of the vehicle. Alternatively, the threshold 500 may be a dynamic threshold. Such as threshold 500 may vary or change with respect to time based on one or more factors, such as the speed of the vehicle 100 (shown in FIG. 1), the operational settings of the vehicle (e.g., the throttle or power settings of one or more of the traction motors 202 (shown in FIG. 2) in the lead powered unit 102 (shown in FIG. 1) and/or brake settings), and the like. By way of example, the threshold 500 may decrease when the vehicle 100 slows down such that if communication is lost between the lead and remote powered units 102, 104, 106, 108, and/or 110, a smaller difference between the throttle and/or power settings of the powered units 102, 104, 106, 108, 110 may be allowed (relative to the allowed difference prior to the slow down) before control of the throttle and/or power settings of the remote powered units switches from automatic to manual control. Conversely, the threshold 500 may increase when the vehicle 100 speeds up, such that a larger difference between the throttle and/or power settings may be permitted before control is switched from automatic control to manual control.

In another embodiment, the threshold 500 may vary based on upcoming terrain of the route 114 (shown in FIG. 1). For example, the vehicle 100 (shown in FIG. 1) may travel along the route 114 toward upcoming terrain. A map or other representation of the terrain may be stored in the medium 210 (shown in FIG. 2) and may include indications of changes in geographic characteristics of the route 114 (e.g., grade and/or curvature in the route 114, as well as indications of the surrounding geography such as the presence of mountains, hills, rock walls or cliffs, valleys, plateaus, and the like on one or more sides of the route 114). The threshold 500 may be varied based on the geographic characteristics of the upcoming terrain that the vehicle 100 is traveling toward. For example, if the upcoming terrain is relatively flat, the threshold 500 may decrease as less problems with the communication connections are expected, anticipated, or likely to occur. On the other hand, if the upcoming terrain includes tunnels, mountains, travelling through a valley, and the like, then the threshold 500 may be increased as some interruption (e.g., communication gaps 306) in communication is expected to occur.

As another example, the threshold 500 may be varied based on differences between geographic characteristics of a current or previous segment of the route 114 (shown in FIG. 1) that the vehicle 100 (shown in FIG. 1) is traveling or has traveled on and geographic characteristics of an upcoming segment of the route 114 that the vehicle 100 will or is scheduled to travel along. For example, if the geographic characteristics change such that the vehicle 100 is traveling from an area with a low likelihood of communication loss (e.g., in a flat geographic plain) to an area with a greater likelihood of communication loss (e.g., a tunnel or valley), the threshold 500 may be decreased if the differences (e.g., calculated difference between the grades, curvatures, elevation of the surrounding terrain, and the like) exceed a designated geographic threshold, such as a non-zero threshold. Alternatively, if the differences in the geographic characteristics do exceed the geographic threshold, then the threshold 500 may not change.

In another example, if the geographic characteristics change such that the vehicle 100 is traveling from an area with a greater likelihood of communication loss to an area of lower likelihood of communication loss, the threshold 500 may be increased if the differences exceed a designated geographic threshold, such as a non-zero threshold. Alternatively, if the differences in the geographic characteristics do exceed the geographic threshold, then the threshold 500 may not change.

The operational differences 416 between the operational settings of the powered units 102, 104, 106, 108, 110 can be repeatedly compared to the static or dynamic threshold 500 during a communication gap 306 (shown in FIG. 3) to determine if and/or when control of the operational settings of the remote powered units 104, 106, 108, 110 is switched from automatic to manual control. For example, during a communication gap 306, the throttle and/or power differences between the lead and remote powered units may increase and/or decrease with respect to time. If the differences between the throttle and/or power settings of the lead powered unit 102 and one or more of the remote powered units 104, 106, 108, and/or 110 become relatively large and exceed the propulsion threshold 500 during the communication loss, then the control module 220 may switch control of the throttle and/or power settings of the remote powered units 104, 106, 108, 110 from automatic control to manual control.

However, if the differences between the throttle and/or power settings do not exceed the threshold 500 during the communication loss, then the control module 220 may not switch from automatic control to manual control, and the control module 220 may continue to automatically control the throttle and/or power settings of the remote powered units 104, 106, 108, and/or 110 during the communication gap 306.

Figure 6:
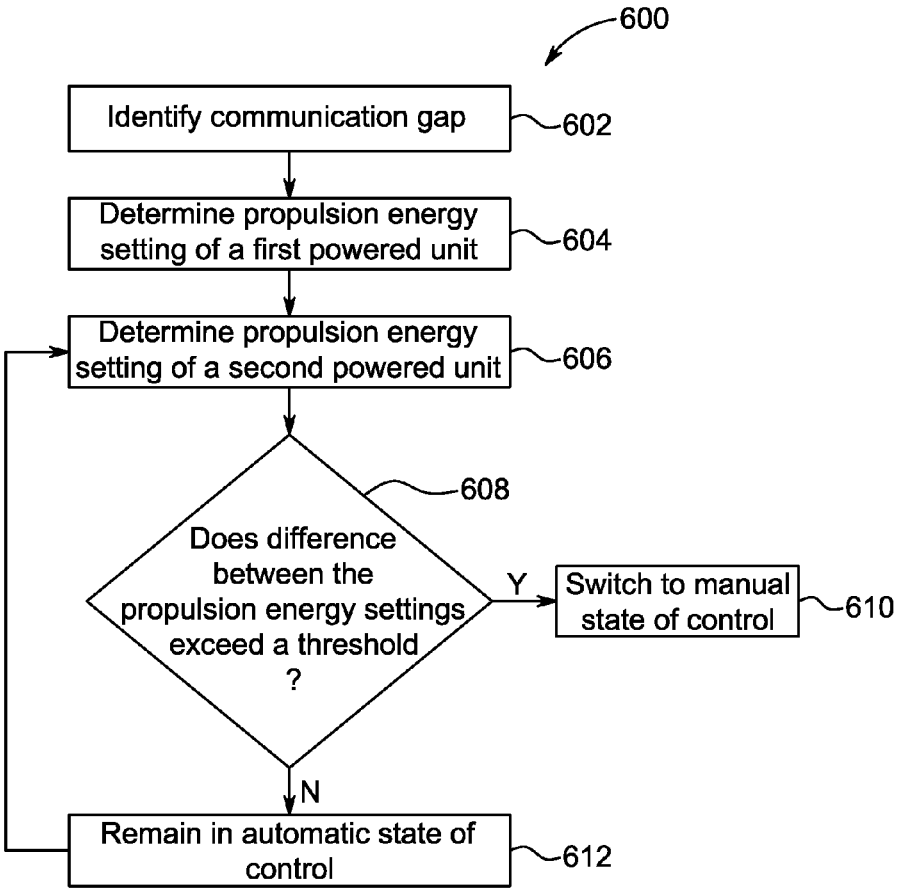
FIG. 6 is a flowchart of a method for controlling communications between powered units in a vehicle.

FIG. 6 is a flowchart of a method 600 for controlling communications between powered units in a vehicle. In one embodiment, the method 600 may be implemented in connection with the communication management system 200 shown in FIG. 2. At 602, a communication gap is identified. For example, the communication gap 306 between the lead powered unit 102 and one or more of the remote powered units 104, 106, 108, 110 is identified.

At 604, an operational setting, such as a propulsion energy setting, of a first powered unit is determined. For example, the throttle and/or power setting of traction motors 202 of one or more remote powered units 104, 106, 108, 110 may be determined. At 606, an operational setting of a second powered unit is determined. For example, the throttle and/or power setting of the traction motors 202 of the lead powered unit 102 may be determined.

At 608, a determination is made as to whether a difference in the operational settings of the first and second powered units exceeds a threshold. For example, the difference between the propulsion energy settings of the lead powered unit 102 and one or more of the remote powered units 104, 106, 108, and/or 110 is compared to the propulsion threshold 500. If the difference between the propulsion energy settings exceeds the threshold 500, the flow of the method 600 continues to 610. Alternatively, if the difference between the propulsion energy settings does not exceed the threshold 500, the flow of the method 600 continues to 612.

At 610, a control state of the vehicle is switched from automatic control to manual control. For example, the control module 220 in the lead powered unit 102 may change from an automatic state (where the control module 220 automatically changes the propulsion energy settings of the remote powered units 104, 106, 108, and/or 110) to a manual state (where a human operator changes the propulsion energy settings).

At 612, the control state of the vehicle remains in the automatic state. For example, the control module 220 in the lead powered unit 102 may remain in the automatic state even though the lead powered unit 102 may be unable to successfully communicate instructions to the remote powered unit 104, 106, 108, and/or 110 due to the communication gap 306. Flow of the method 600 may return to 606, where the operational setting(s) of the lead powered unit 102 is again determined and compared to the previously determined operational settings of the remote powered units 104, 106, 108, 110 to decide whether to remain in an automatic control state or switch to a manual control state, as described above.

In another embodiment, a system (e.g., a system for communication between powered units of a vehicle) includes a control module, a communication module, and a management module. The control module is configured to be disposed on-board the vehicle that includes a lead powered unit and at least one remote powered unit that are capable of self-propulsion. The control module also is configured to operate in an automatic mode where the control module automatically controls operational settings of the at least one remote powered unit and in a manual mode where an operator onboard the vehicle manually controls the operational settings of the at least one remote powered unit. The communication module is configured to be disposed on-board the vehicle and to monitor communication of control instructions from the control module to the at least one remote powered unit when the control module operates in the automatic mode. The communication module also is configured to identify when the communication of the control instructions is interrupted. The management module is configured to be disposed on-board the vehicle and to determine one or more operational setting differences between operational settings of the lead powered unit and the operational settings of the at least one remote powered unit when the interruption in communication is identified by the communication module. The management module is further configured to prevent the control module from switching from the automatic mode to the manual mode when the one or more operational setting differences remain meet one or more designated criteria.

In another aspect, the operational settings of the at least one remote powered unit include at least one of throttle settings, power settings, or brake settings of the at least one remote powered unit.

In another aspect, the control module is configured to automatically control the operational settings of the at least one remote powered unit according to a trip plan of the vehicle. The trip plan designates propulsion energy settings of the at least one remote powered unit as a function of at least one of distance or time along a route during a trip in order to reduce at least one of fuel consumed or emissions generated by the vehicle relative to operating the at least one remote powered unit according to one or more propulsion energy settings other than the propulsion energy settings designated by the trip plan.

In another aspect, the communication module is configured to identify the interruption in communication when a confirmation message is not received from the at least one remote powered unit in response to transmission of one or more of the control instructions to the at least one remote powered unit.

In another aspect, the one or more designated criteria comprise the one or more operational setting differences remaining below a designated threshold, and the management module is configured to dynamically change the threshold to which the one or more operational setting differences are compared as the vehicle travels along a route.

In another aspect, the management module is configured to dynamically change the threshold based on a change in one or more geographic characteristics of a current segment of the route on which the vehicle is traveling and one or more geographic characteristics of an upcoming segment of the route on which the vehicle will travel.

In another aspect, the management module is configured to dynamically change the threshold based on a speed at which the vehicle is moving along the route.

In another aspect, the one or more designated criteria comprise the one or more operational setting differences remaining below a designated threshold, and the management module is configured to switch the control module from the automatic mode to the manual mode when the one or more operational setting differences exceed the threshold.

In another embodiment, a method (e.g., a method for communicating between powered units of a vehicle) includes automatically controlling operational settings of at least one remote powered unit in a vehicle by communicating control instructions with the at least one remote powered unit from a lead powered unit of the vehicle, identifying an interruption in communication of the control instructions with the at least one remote powered unit, and determining one or more operational setting differences between operational settings of the lead powered unit and the operational settings of the at least one remote powered unit when the interruption in communication is identified. The method also includes preventing a switch from automatic control of the operational settings of the at least one remote powered unit to manual control of the operational settings of the at least one remote powered unit when the one or more operational setting differences meet one or more designated criteria.

In another aspect, the operational settings of the at least one remote powered unit include at least one of throttle settings, power settings, or brake settings of the at least one remote powered unit.

In another aspect, automatically controlling the operational settings of the at least one remote powered unit includes automatically controlling the operational settings of the at least one remote powered unit according to a trip plan of the vehicle. The trip plan designates propulsion energy settings of the at least one remote powered unit as a function of at least one of distance or time along a route during a trip in order to reduce at least one of fuel consumed or emissions generated by the vehicle relative to operating the at least one remote powered unit according to one or more propulsion energy settings other than the propulsion energy settings designated by the trip plan.

In another aspect, identifying the interruption in communication includes determining when a confirmation message is not received from the at least one remote powered unit in response to transmission of one or more of the control instructions to the at least one remote powered unit.

In another aspect, the one or more designated criteria comprise the one or more operational setting differences remaining below a designated threshold, and the method also includes changing the threshold to which the one or more operational setting differences are compared as the vehicle travels along a route.

In another aspect, the threshold is changed based on a change in one or more geographic characteristics of a current segment of the route on which the vehicle is traveling and one or more geographic characteristics of an upcoming segment of the route on which the vehicle will travel.

In another aspect, the threshold is changed based on a speed at which the vehicle is moving along the route.

In another aspect, the one or more designated criteria comprise the one or more operational setting differences remaining below a designated threshold, and the method also includes switching from the automatic control to the manual control of the at least one remote powered unit when the one or more operational setting differences exceed the threshold.

In another embodiment, a communication management system for a rail vehicle includes a control module, a communication module, and a management module. The control module is configured to be disposed on-board a lead powered unit of the rail vehicle and to automatically change one or more propulsion energy settings of at least one remote powered unit of the rail vehicle. The communication module is configured to be disposed on-board the lead powered unit and to transmit instructions to the at least one remote powered unit to automatically change the propulsion energy settings of the at least one remote powered unit. The communication module is further configured to identify communication gaps that represent interruption in one or more communication connections between the lead powered unit and the at least one remote powered unit. The management module is configured to be disposed on-board the lead powered unit and to compare the propulsion energy settings of the lead powered unit and the propulsion energy settings of the at least one remote powered unit during one or more of the communication gaps. The management module is further configured to, based on the propulsion energy settings of the lead powered unit and the at least one remote powered unit, prevent the control module from switching from automatic control of the propulsion energy settings of the at least one remote powered unit to manual control of the propulsion energy settings of the at least one remote powered unit.

In another aspect, the management module is configured to determine an operational setting difference between the propulsion energy settings of the lead powered unit and the propulsion energy settings of the at least one remote powered unit. The management module is further configured to prevent the control module from switching from the automatic control to the manual control based on the operational setting difference.

In another aspect, the management module is configured to compare the operational setting difference to a designated threshold to determine whether to prevent the control module from switching from the automatic control to the manual control.

In another aspect, the threshold is based on a speed of the rail vehicle.

In another aspect, the threshold is based on a difference between a geographic characteristic of a current segment of a route being traveled by the rail vehicle and a geographic characteristic of an upcoming segment of the route that will be traveled by the rail vehicle.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are example embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter, including the best mode, and also to enable a person of ordinary skill in the art to practice the embodiments of inventive subject matter, including making and using any devices or systems and performing any incorporated methods. The patentable scope of the inventive subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:

a control module configured to be disposed on-board a vehicle that includes a lead powered unit and at least one remote powered unit that are capable of self-propulsion, the control module also configured to operate in an automatic mode where the control module automatically controls operational settings of the at least one remote powered unit and in a manual mode where an operator onboard the vehicle manually controls the operational settings of the at least one remote powered unit;

a communication module configured to be disposed on-board the vehicle and to monitor communication of control instructions from the control module to the at least one remote powered unit when the control module operates in the automatic mode, the communication module configured to identify when the communication of the control instructions is interrupted; and a management module configured to be disposed on-board the vehicle and to determine one or more operational setting differences between operational settings of the lead powered unit and the operational settings of the at least one remote powered unit when the interruption in communication is identified by the communication module, wherein the management module is further configured to prevent the control module from switching from the automatic mode to the manual mode when the one or more operational setting differences meet one or more designated criteria.

2. The system of claim 1, wherein the operational settings of the at least one remote powered unit include at least one of throttle settings, power settings, or brake settings of the at least one remote powered unit.

3. The system of claim 1, wherein the control module is configured to automatically control the operational settings of the at least one remote powered unit according to a trip plan of the vehicle, the trip plan designating propulsion energy settings of the at least one remote powered unit as a function of at least one of distance or time along a route during a trip in order to reduce at least one of fuel consumed or emissions generated by the vehicle relative to operating the at least one remote powered unit according to one or more propulsion energy settings other than the propulsion energy settings designated by the trip plan.

4. The system of claim 1, wherein the communication module is configured to identify the interruption in communication when a confirmation message is not received from the at least one remote powered unit in response to transmission of one or more of the control instructions to the at least one remote powered unit.

5. The system of claim 1, wherein the one or more designated criteria comprise the one or more operational setting differences remaining below a designated threshold, and wherein the management module is configured to dynamically change the threshold to which the one or more operational setting differences are compared as the vehicle travels along a route.

6. The system of claim 5, wherein the management module is configured to dynamically change the threshold based on a change in one or more geographic characteristics of a current segment of the route on which the vehicle is traveling and one or more geographic characteristics of an upcoming segment of the route on which the vehicle will travel.

7. The system of claim 5, wherein the management module is configured to dynamically change the threshold based on a speed at which the vehicle is moving along the route.

8. The system of claim 1, wherein the one or more designated criteria comprise the one or more operational setting differences remaining below a designated threshold, and wherein the management module is configured to switch the control module from the automatic mode to the manual mode when the one or more operational setting differences exceed the threshold.

9. A method comprising:

automatically controlling operational settings of at least one remote powered unit in a vehicle by communicating control instructions with the at least one remote powered unit from a lead powered unit of the vehicle;

identifying an interruption in communication of the control instructions with the at least one remote powered unit;

determining one or more operational setting differences between operational settings of the lead powered unit and the operational settings of the at least one remote powered unit when the interruption in communication is identified; and preventing a switch from automatic control of the operational settings of the at least one remote powered unit to manual control of the operational settings of the at least one remote powered unit when the one or more operational setting differences meet one or more designated criteria.

10. The method of claim 9, wherein the operational settings of the at least one remote powered unit include at least one of throttle settings, power settings, or brake settings of the at least one remote powered unit.

11. The method of claim 9, wherein automatically controlling the operational settings of the at least one remote powered unit includes automatically controlling the operational settings of the at least one remote powered unit according to a trip plan of the vehicle, the trip plan designating propulsion energy settings of the at least one remote powered unit as a function of at least one of distance or time along a route during a trip in order to reduce at least one of fuel consumed or emissions generated by the vehicle relative to operating the at least one remote powered unit according to one or more propulsion energy settings other than the propulsion energy settings designated by the trip plan.

12. The method of claim 9, wherein identifying the interruption in communication includes determining when a confirmation message is not received from the at least one remote powered unit in response to transmission of one or more of the control instructions to the at least one remote powered unit.

13. The method of claim 9, wherein the one or more designated criteria comprise the one or more operational setting differences remaining below a designated threshold, and the method further comprises changing the threshold to which the one or more operational setting differences are compared as the vehicle travels along a route.

14. The method of claim 13, wherein the threshold is changed based on a change in one or more geographic characteristics of a current segment of the route on which the vehicle is traveling and one or more geographic characteristics of an upcoming segment of the route on which the vehicle will travel.

15. The method of claim 13, wherein the threshold is changed based on a speed at which the vehicle is moving along the route.

16. The method of claim 9, wherein the one or more designated criteria comprise the one or more operational setting differences remaining below a designated threshold, and the method further comprises switching from the automatic control to the manual control of the at least one remote powered unit when the one or more operational setting differences exceed the threshold.

* * * * *

UNITED STATES PATENT AND TRADEMARK OFFICE

CERTIFICATE OF CORRECTION

PATENT NO. : 8,682,513 B2
APPLICATION NO. : 13/443400
DATED : March 25, 2014
INVENTOR(S) : Chen et al.

It is certified that error appears in the above-identified patent and that said Letters Patent is hereby corrected as shown below:

In the Specification

In Column 11, Line 26, delete “alter” and insert -- after --, therefor.

Signed and Sealed this
Third Day of June, 2014

Michelle K. Lee

Michelle K. Lee
*Deputy Director of the United States Patent and Trademark Office*